United States Patent [19]

Connick, Jr. et al.

[11] 3,976,818

[45] Aug. 24, 1976

[54] POLYFLUORINATED AMINE OIL-REPELLENT, STAIN-RELEASE FABRIC TREATMENT

[75] Inventors: William J. Connick, Jr.; Samuel E. Ellzey, Jr., both of New Orleans, La.

[73] Assignee: The United States of America as represented by the Secretary of Agriculture, Washington, D.C.

[22] Filed: July 18, 1972

[21] Appl. No.: 272,813

[52] U.S. Cl. ..... 427/381; 106/2; 252/8.8; 427/390; 427/394

[51] Int. Cl.[2] ..... C09K 3/18

[58] Field of Search ..... 106/2, 13; 252/8.8; 427/381, 390, 392, 394, 396

[56] References Cited

UNITED STATES PATENTS

| | | | |
|---|---|---|---|
| 3,035,053 | 9/1962 | Coates et al. | 106/15 |
| 3,655,413 | 4/1972 | Ellzey et al. | 427/381 X |

*Primary Examiner*—Michael R. Lusignan
*Attorney, Agent, or Firm*—M. Howard Silverstein; Salvador J. Cangemi; David G. McConnell

[57] ABSTRACT

The product of the reaction of tetrakis(hydroxymethyl)phosphonium salts and primary 1,1-dihydroperfluoroalkylamines, when applied from aqueous emulsions to which basic substances have been added, renders textiles repellent to oil and water and improves their anti-stain properties.

4 Claims, No Drawings

POLYFLUORINATED AMINE OIL-REPELLENT, STAIN-RELEASE FABRIC TREATMENT

A non-exclusive, irrevocable, royalty-free license in the invention herein described, throughout the world for all purposes of the United States Government, with the power to grant sublicenses for such purposes, is hereby granted to the Government of the United States of America.

This invention relates to a process for conferring on textile materials oil and water repellency, stain resistance, and stain release properties. More particularly, solutions or emulsions of the products of the reaction of primary 1,1-dihydroperfluoroalkylamines and methylol phosphonium salts are modified by the addition of inorganic or organic bases and these modified solutions or emulsions may be used to treat textile materials, using conventional textile mill equipment, to render the textile water and oil repellent.

Still more specifically, this invention relates to a modification of the product described in U.S. Pat. No. 3,655,413, issued Apr. 11, 1972. The product described therein is formed by the reaction of primary 1,1-dihydroperfluoroalkylamines of the general formula $R_FCH_2NH_2$, wherein $R_F$ is a straight-or branched-chain perfluorinated alkyl group, such as, for example, $C_5F_{11}$, $C_6F_{13}$, $C_7F_{15}$, and the like, and a tetrakis (hydroxymethyl) phosphonium salt of the general formula $[(HOCH_2)_4P^+]^{n}\,A^{-n}$, wherein n is the valence of the anion A, which may be any of the common anions such as, for example, Cl, Br, I, $SO_4$, $PO_4$, acetate, and so forth. A novel feature of the present invention relates to the addition of basic substances to emulsions, or solutions in organic solvents, of the above reaction product. These basic substances may be any inorganic base or organic base such as, for example: alkali hydroxides such as sodium or potassium hydroxide; basic salts such as sodium acetate, sodium carbonate, and sodium bicarbonate; and tertiary amines such as triethylamine, triethanolamine, and hexamethylenetetramine. As noted in the above mentioned patent, the solution or emulsion of the reaction product is quite acidic and its application to textiles without neutralization of the acidity causes severe strength losses in the treated textile.

Still more specifically, this invention relates to the application to textiles of an aqueous emulsion of the product formed by reaction of 1,1-dihydroperfluorooctylamine (POA), $C_7F_{15}CH_2NH_2$, and tetrakis (hydroxymethyl) phosphonium chloride (THPC) to which has been added a sufficient quantity of a basic substance to raise the emulsion pH to a value between about 4 and 8.

The object of this invention is to provide a process whereby textile materials are rendered highly oil repellent and slightly water repellent and are imparted enhanced stain release properties. As a consequence of being rendered oil and water repellent, the textile materials are rendered more resistant to water-borne stains, but more particularly to oil-borne stains. By virtue of having stain release properties, forced-in stains can easily be removed by laundering.

The textile materials contemplated with the scope of this invention include cotton, rayon, wool, polyester, nylon, and blends of these substances. Application may also be made to leather, paper, and glass. Although various types of materials are suitable for the practice of the invention, the examples given below will use cotton fabric to illustrate utility.

The process set forth in greater detail in U.S. Pat. No. 3,655,413 and in Ellzey, et al., Textile Res. J., 39, 809 (1969) involves the application to textiles of the reaction product of one mole of POA and one mole of THPC, hereafter called POA-THPC solids, and its fixation or insolubilization on the fabric by subsequent reaction with ammonia vapors. This process requires the use of special equipment and techniques to provide the ammonia treatment. The process of the present invention requires only standard mill equipment and techniques. An ammonia treatment is not necessary, thereby eliminating a separate process step and the need for special and expensive equipment.

The water- and ethanol-insoluble products formed from the reaction of equimolar amounts of POA and THPC treated with (a) NaOH and (b) $NH_3$ gave the elemental analyses listed in Table 1. The significant differences in N, P, and F content of the two products show that a

TABLE 1

| FORMULATION | %C | %H | %N | %P | %F |
|---|---|---|---|---|---|
| POA+THPC+NaOH | 26.11 | 1.31 | 3.57 | 3.24 | 65.87 |
| POA+THPC+$NH_3$ | 28.73 | 2.05 | 5.39 | 6.62 | 49.30 |

considerable difference in composition exists. The higher nitrogen content of the product treated with ammonia shows that the ammonia has actually become a part of the product by reacting with the POA-THPC solids or THPC, and has not merely functioned as a base.

The bases contemplated in the present invention would not necessarily be of a type that could be incorporated as part of the finish, as ammonia could.

The POA-THPC solids can be applied to cotton fabric from solution or emulsion by any suitable means such as, for example, dipping and padding between squeeze rolls, spraying, or by exhaustion. Application may be from certain inert organic solvents, but application from aqueous emulsion is the most advantageous method. In the preferred method, a solution of the THPC and an emulsifier in water is mixed with the fluorinated amine (which may also have an emulsifier mixed with it) and vigorously stirred to provide a stable emulsion. The desired amount of base is then added to the emulsion to complete the padding bath. After treatment with this emulsion, the fabric is dried, heat-cured, rinsed, and re-dried in the conventional manner. Equally suitable variations of this general procedure will be apparent to those skilled in the art.

TABLE 2

SOME PROPERTIES OF TREATED COTTON PRINT CLOTH

| Sample | Description | Bath pH | Cure[1] Temp. C° | % POA-THPC[2] SOF | Spray Rating | Oil Repellency Rating (AATCC) Initial | Terg-O-Tometer washing, hrs. 1 | 2 | 3 | Break. Str., lbs. | Wrinkle Recovery Warp + Fill, deg. Cond. | Wet |
|---|---|---|---|---|---|---|---|---|---|---|---|---|
| 1 | No base | 2.2 | 150 | 2.0 | 50 | 6 | 5 | 2 | 0 | 8.0 | — | — |

TABLE 2-continued

SOME PROPERTIES OF TREATED COTTON PRINT CLOTH

| Sample | Description | Bath pH | Cure[1] Temp. C° | % POA-THPC[2] SOF | Spray Rating | Oil Repellency Rating (AATCC) Terg-O-Tometer washing, hrs. Initial | 1 | 2 | 3 | Break. Str., lbs. | Wrinkle Recovery Warp + Fill, deg. Cond. | Wet |
|---|---|---|---|---|---|---|---|---|---|---|---|---|
| | added | | | | | | | | | | | |
| 2 | Ammonia cured | 2.4 | Room Temp. | 2.0 | 50 | 6 | 6 | 0 | — | 48.1 | — | — |
| 3 | Sodium acetate added. | 5.0 | 150 | 2.1 | 50 | 6 | 6 | 3 | 0 | 45.2 | 222 | 160 |
| 4 | POA-THPC + Permafresh Reagent | 5.0 | 160 | 2.2 | 50 | 4 | 4 | 4 | 2 | 26.4 | 277 | 277 |
| 5 | Untreated | — | — | — | — | — | — | — | — | 49.2 | 192 | 159 |

[1]Three minutes duration.
[2]% Solids-on-fabric is calculated as the product of wet pickup and bath concentration.

Some properties of cotton print cloth treated with various formulations are given in Table 2. It should be noted that if the addition of base is omitted (sample 1, ), the acidic bath causes an extreme tensile strength loss in the fabric after high temperature curing. Curing with ammonia vapors (sample 2) overcomes this tensile strength loss but requires the special and disadvantageous equipment and techniques already mentioned. The addition of sodium acetate to the POA-THPC emulsion to pH 5 (sample 3) protects the fabric from severe strength loss and slightly increases the durability of oil repellency to laundering.

Base concentration is generally chosen to minimize tensile strength loss by pH control; the preferred pH range for the bath is from about 4 to 8. The order of addition of the base may be varied without apparent effect on oil repellency. Base may be first added to the THPC-emulsifier solution until the desired pH is reached or it may be added to a completed POA-THPC emulsion.

Curing temperatures of 80°–170°C or higher may be used, but the preferred range to obtain maximum durability of oil repellency is 130°–160°C with a duration of about 2-5 minutes.

A fluorinated amine: THPC molar ratio of 1:1 is preferred for economic reasons, but useful properties can be obtained when a greater or lesser proportion of amine is used. For a high level of oil repellency which is also durable to laundering and extraction with perchloroethylene (a commonly-used drycleaning solvent), 1–5% or more of the POA-THPC solids should be applied to the fabric but a lesser amount will be suitable for many purposes.

Triton X-100 (Rohm and Haas Co.), an octylphenoxyethanol, Tergitol TMN (Union Carbide Corp.), a trimethylnonyloxyethanol, and similar nonionic emulsifiers were found to be suitable for preparing stable POA-THPC emulsions. A concentration of 0.5–5% based on the weight of the bath is effective. Emulsions prepared by the process of this invention are normally stable for at least five weeks.

THe POA-THPC finish may be co-applied with formulations designed to give other desirable properties to textiles, such as flame retardancy and wrinkle resistance. For example, it may be mixed with commercially available permanent press formulations of various structural types, such as Permafresh Reagent 183 (Sun Chemical Corp.), an imidazolidone type, Resloom HP (monsanto), a methylol melamine type, or Kara Set 1480 (Millmaster Onyx Corp.), a carbamate type, to impart wrinkle resistance as well as oil repellency and stain release properties. Durability of oil repellency to laundering is often increased when such combinations are used (see Table 2, sample 4). Some commercial permanent press formulations may be basic enough to effect pH control without added base.

Durability of oil repellency to laundering was determined with a Terg-O-Tometer (United States Testing Co., Model 7243) whose temperature was set for 60°C. To one of the beakers was added 1 liter of hot tap water and 4 g of All (Lever Bros. Co.) granular detergent. A batch of six samples, each 6 inches square, was added and washed with agitation at 125 cycles per minute for 1 hour. The samples were rinsed three times, three minutes per rinse, with clear water at 60°C while agitating at 125 cycles per minute. After squeezing through a wringer, the samples were oven dried at 85°C for 10 minutes, then rated for oil repellency.

Fabrics treated with the POA-THPC finish are resistant to oil-and water-bone stains by virtue of their oil- and water-repellent properties. Should a stain be forced into the fabric, the stain release properties of the finish allow its removal by simple laundering.

Stain repellency of the treated fabrics was checked by applying, under pressure, several common staining materials including coffee with cream and sugar, a mineral oil, a French salad dressing, a cola soft drink, a prepared yellow mustard, and used motor oil. After line-drying for one day, the samples were given one home-type laundering and the stain repellency (before laundering) and stain release (after laundering) were visually compared. The testing procedure is more completely described in Connick and Ellzey, Textile Res. J., 40, 185 (1970).

Water repellency was measured by the spray test (AATCC Technical Manual, 1967, Method 22–1967), and oil repellency by AATCC Method 118–1966. Breaking strength was determined by ASTM Method D1682-64 (Instron, ravelled to 1 in., warp), and wrinkle recovery by ASTM Method D1295-60T.

The following examples are given by way of illustration and are not to be construed as limiting the scope of this invention.

EXAMPLE 1

An emulsion containing THPC and 1,1-dihydroperfluorooctylamine (2.2% POA-THPC solids) was prepared in the following manner: to a solution of 5.4 g of 80% THPC solution (aqueous) and 12 g of Triton X-100 in 560 g of water was added a mixture of 9 g of the fluorinated amine and 6 g of Triton X-100. The total mixture was rapidly stirred for 1 minute with a high speed stirrer to effect emulsification. A total of 9 g of a 33% sodium acetate solution (aqueous) was added to this emulsion to raise the pH to a value of 5. A piece of 80 X 80 desized, scoured, and bleached cotton printcloth (about 3.2 oz./sq.yd.) was padded with the emulsion to a wet pickup of 96% and dried in a laboratory oven at 80°C for 5 min. The fabric was then oven-cured at 150°C for 3 min. After rinsing in hot water, the fabric was line dried. The treatment did not cause discoloration or stiffness. Initial oil repellency (oil repellency rating =6) was high (see Table 2, sample 3) and fairly durable through 2 hours of Terg-O-Tometer washing. The fabric exhibited some water repellency (spray rating = 50). The finish showed good repellency to the common stains tested and each, even the used motor oil, was almost completely removed by one home-type laundering.

EXAMPLE 2

An emulsion containing 1.1% POA-THPC solids was prepared as in Example 1 from 0.9 g of 80% THPc solution, 1.5 g of POA, 6 g of Triton X-100, 191 g of water, and 1 g of 33% sodium acetate solution. When applied to cotton printcloth by the process of Example 1, an initial oil repellency rating of 6 was obtained.

EXAMPLE 3

An emulsion containing 4.4% POA-THPC solids was prepared as in Example 1 from 3.6 g of 80 % THPC solution, 6 g of POA, 6 g of Triton X-100, 181 g of water, and 4 g of 33% sodium acetate solution. When applied to cotton printcloth by the process of Example 1, an initial oil repellency rating of 7 and an initial spray rating of 70 were obtained.

EXAMPLE 4

An emulsion was prepared as in Example 1 but with sodium hydroxide as the base (added to pH=7.1). Cotton printcloth treated with this emulsion under the conditions of Example 1 was rendered oil repellent (oil repellency rating = 6) and water repellent (spray rating = 50) and had good anti-stain properties. There was no tensile strength loss for the treated fabric when compared with an untreated control.

EXAMPLE 5

An emulsion was prepared as in Example 1 but with triethanolamine as the base (added to pH=4.8). Cotton printcloth treated with this emulsion under the conditions of Example 1 was rendered oil repellent (oil repellency rating = 6) and water repellent (spray rating =50). There was little tensile strength loss of the treated fabric.

EXAMPLE 6

The procedure of Example 1 was used to treat a blended twill fabric containing 65% polyester and 35% cotton. The fabric was rendered highly oil repellent (oil repellency rating = 6).

EXAMPLE 7

An emulsion containing 2.2% POA-THPC solids and 10% solids of the commercial permanent press formulation Permafresh Reagent 183 was prepared as follows: to a solution of 0.7 g of 80% THPC solution (aqueous) and 1.5 g Triton X-100 in 49 g water was added a mixture of 1.1 g of the fluorinated amine and 0.5 g of Triton X-100. The mixture was rapidly stirred for 1 min. with a high speed stirrer to effect emulsification. To this emulsion was added 16.7 g of Permafresh Reagent 183 (supplied as a 45% solids aqueous solution), then 4.5 g of a 50% aqueous magnesium chloride hexahydrate solution. The pH of this emulsion was raised to a value of 5 by the addition of 1 g of 33% aqueous sodium acetate solution.

Cotton printcloth was treated with this emulsion by padding to a 98% wet pickup, drying at 85°C for 5 min., curing at 160°C for 3 min., rinsing in hot water, and line-drying. The fabric was rendered oil and water repellent (Table 2, sample 4). Durability of oil repellency to laundering was slightly improved over the finish of Example 1. Wrinkle recovery angles were significantly higher than those for the POA-THPC finish alone. The fabric exhibited good stain repellency and stain release properties.

We claim:

1. A process for imparting oil repellency and anti-stain properties to a textile fabric, which process comprises:

a. padding the textile fabric with a treating composition consisting of an aqueous emulsion containing about 1-5 wt. % of a product prepared by mixing equimolar amounts of 1,1-dihydroperfluorooctylamine and tetrakis (hydroxymethyl) phosphonium chloride in water in the presence of an emulsifier consisting of an octylphenoxyethanol or a trimethylnonyloxyethanol- and to which emulsion has been added a basic substance selected from the group consisting of sodium acetate, sodium hydroxide, and triethanolamine to raise the pH to between about 4.8 and 7.1 b. drying the padded fabric from (a) .

c. curing the dried fabric from (b).

2. The process of claim 1 wherein the basic substance is sodium acetate and the emulsifier is an octylphenoxyethanol.

3. The process of claim 1 wherein the basic substance is sodium hydroxide and the emulsifier is an octylphenoxyethanol.

4. The process of claim 1 wherein the basic substance is triethanolamine and the emulsifier is an octylphenoxyethanol.

* * * * *